US008986037B2

(12) United States Patent
Boemmel et al.

(10) Patent No.: US 8,986,037 B2
(45) Date of Patent: Mar. 24, 2015

(54) ELECTRICAL PLUG ELEMENT WITH CONTACT LOCK MEMBER AND TEST STOP

(75) Inventors: Christian Otto Boemmel, Langen (DE); Rolf Jetter, Darmstadt (DE)

(73) Assignee: Tyco Electronics AMP GmbH, Bensheim (DE)

( * ) Notice: Subject to any disclaimer, the term of this patent is extended or adjusted under 35 U.S.C. 154(b) by 56 days.

(21) Appl. No.: 13/880,702

(22) PCT Filed: Oct. 17, 2011

(86) PCT No.: PCT/EP2011/068071

§ 371 (c)(1), (2), (4) Date: Apr. 19, 2013

(87) PCT Pub. No.: WO2012/052382

PCT Pub. Date: Apr. 26, 2012

(65) Prior Publication Data

US 2013/0210260 A1 Aug. 15, 2013

(30) Foreign Application Priority Data

Oct. 22, 2010 (DE) ..... 10 2010 042 826

(51) Int. Cl.
*H01R 13/436* (2006.01)
*H01R 13/50* (2006.01)
*H01R 13/641* (2006.01)

(52) U.S. Cl.
CPC ..... *H01R 13/4361* (2013.01); *H01R 13/501* (2013.01); *H01R 13/641* (2013.01)
USPC ..... 439/357

(58) Field of Classification Search
USPC ..... 439/352, 357, 595, 752
See application file for complete search history.

(56) References Cited

U.S. PATENT DOCUMENTS 5,620,346 A * 4/1997 Okumura ..... 439/752
5,860,834 A * 1/1999 Sugiyama ..... 439/595

(Continued)

FOREIGN PATENT DOCUMENTS

DE 10218749 C1 10/2003
EP 1811609 A1 7/2007
FR 2784510 A1 4/2000

OTHER PUBLICATIONS

International Preliminary Report on Patentability issued by the International Bureau of WIPO, Geneva, Switzerland, dated Apr. 23, 2013, for related International Application No. PCT/EP2011/068071; 6 pages.

(Continued)

*Primary Examiner* — Alexander Gilman
(74) *Attorney, Agent, or Firm* — Faegre Baker Daniels LLP

(57) ABSTRACT

The present invention relates to a plug element (1, 1', 1", 1'", 1"") with a plugging section (2) which is configured to be able to be brought together in a direction of plugging (Z) of the plug element (1, 1', 1", 1'", 1"") with a mating plug element (100) and has at least one receptacle (5) for an electrical plug-in contact, and with a contact lock member (8) which, at least in its securing position (S), projects, at least in sections, into the receptacle (5). In order, with the smallest possible external dimensions of the plug element (1, 1', 1", 1'", 1""), to be able simply to feel that the securing position (S) has been reached, provision is made according to the invention for the contact lock member (8) in the securing position (S) to release a test path (P) along which a test member (3, 200) can be moved past a test stop (18).

9 Claims, 9 Drawing Sheets

(56) References Cited

U.S. PATENT DOCUMENTS

| | | | | |
|---|---|---|---|---|
| 5,890,931 | A * | 4/1999 | Ittah et al. | 439/679 |
| 5,928,038 | A * | 7/1999 | Berg et al. | 439/752 |
| 5,967,843 | A * | 10/1999 | Okabe et al. | 439/596 |
| 6,093,063 | A * | 7/2000 | Tsuji et al. | 439/752 |
| 6,276,964 | B1 * | 8/2001 | Shinozaki | 439/595 |
| 6,638,109 | B2 * | 10/2003 | Kurimoto et al. | 439/595 |
| 7,118,417 | B2 * | 10/2006 | Aihara et al. | 439/595 |
| 7,261,603 | B2 * | 8/2007 | Takahashi et al. | 439/752 |
| 7,331,827 | B2 * | 2/2008 | Gleissner et al. | 439/680 |
| 8,096,841 | B2 * | 1/2012 | Hirano | 439/752 |
| 2007/0093131 | A1 * | 4/2007 | Takahashi et al. | 439/595 |
| 2007/0111599 | A1 * | 5/2007 | Tanaka | 439/595 |

OTHER PUBLICATIONS

International Search Report and Written Opinion issued by the European Patent Office, dated Nov. 16, 2011, for related International Application No. PCT/EP2011/068071; 11 pages.

* cited by examiner

ELECTRICAL PLUG ELEMENT WITH CONTACT LOCK MEMBER AND TEST STOP

The present invention relates to a plug element, both for sealed and for unsealed electrical plug-in connectors, with a plugging section which is configured to be able to be brought together with a mating plug element in a direction of plugging of the plug element and has at least one receptacle for an electrical plug-in contact, and with a contact lock member which, at least in its securing position, projects, at least in sections, into the receptacle.

Plug elements with contact lock members are known from the prior art. The contact lock members, often referred to as second contact lock means, overlap in the securing position with an electrical contact element which is seated in the receptacle and mechanically secure said element against being pulled out of the receptacle. A first mechanical securing of the contact element mostly takes place by a latch spring formed on the element itself, which spring is latched to a projection in the receptacle.

With the plug elements known from the prior art, it is often difficult to establish whether the contact lock member is transferred correctly into the securing position. Initially, it is true that an incorrectly inserted electrical contact element can prevent transferring of the contact lock member into the securing position because it blocks the securing position extending ahead of the contact lock member. If it is then however attempted to transfer the contact lock member into the securing position with increased force being applied, it and/or the contact element may become deformed and, at least from the outside, give the impression that the securing position has been reached.

This problem is aggravated if the plug element is received in a surrounding housing and where possible a sealing element is arranged between the surrounding housing and a conductor receptacle section of the plug element and the plugging section thus is accessible only with difficulty. Checking of the securing position can then take place only with additional auxiliary means, which for example are introduced into a space between the surrounding housing and the plug element, in order to sense the position of the contact lock member. An increased expenditure of force upon the introduction of the auxiliary means may likewise result in deformation of the contact lock member and in false conclusions when checking the securing position.

In view of the problems described above in the case of plug elements known from the prior art, the present invention is based on the object of providing a plug element in which the securing position of the contact lock member can be checked simply and reliably.

This object is achieved according to the invention in that the contact lock member in the securing position releases a test path along which a test member as auxiliary means can be guided past a test stop.

With this solution, it is advantageous for the test stop to be able to block the test member independently of the expenditure of force with which the test member is actuated, and hence to be able to signal that the securing position has not been properly reached. Furthermore, a defined test path can help to guide the test member properly on to or past the test stop. Thus uncontrolled movements of the test member which might result in deformation of the contact lock member or of the test stop can be prevented.

The solution according to the invention can be supplemented and improved further as desired by the following further embodiments, which are each advantageous per se:

Thus provision can be made, according to a first advantageous embodiment of a plug element according to the invention, for the test stop to be formed on the contact lock member. The contact lock member may perform a dual function by firstly securing the electrical contact elements in the receptacles and secondly helping to check that they are seated properly.

The test stop, at least in a securing position of the contact lock member, can point in the direction of plugging and the test path can extend parallel to the direction of plugging. Thus the test member can be introduced counter to the direction of plugging, for example past a plugging face of the plug element or through said element into the plug element or into a gap between the plug element and a surrounding housing. This facilitates in particular checking of the securing position if all the regions of the plug element in a final inserted state, in which it is brought together with a mating plug element, are covered and/or sealed by a surrounding housing as far as the plugging face.

The test path may, at least in sections, be formed by a test recess on the contact lock member. A test recess may help to minimise the external dimensions of the plug element, since the test path formed by the recess does not result in widening of the external dimensions of the plug element. Furthermore, the contact lock member may fulfil an additional function by dictating the test path, at least in sections. The contact lock member can then simply dictate the test path in particular in that provision is made for the test recess to be a slot which may extend for example parallel to the direction of plugging.

The contact lock member can mechanically secure the electrical contact elements in their respective receptacles in that at least one securing element which extends substantially transversely to the direction of plugging can be formed on the contact lock member, which element, at least in the securing position, projects through a test groove or securing groove on the plugging section into the receptacle, the securing groove, at least in sections, running transversely to the direction of plugging and extending into the at least one receptacle, or intersecting with a passage to the receptacle. Such a securing groove is in particular advantageous when a plurality of contact receptacles arranged in a row is provided. The contact lock member can then at the same time help to check that the plurality of contact elements are seated properly in their respective receptacles by means of the securing element which projects into the securing groove.

The securing element and the securing groove can be configured to cooperate with each other as latching means and mating latching means. Thus the securing member can latch on the mating plug element for example upon reaching the securing position. This can help to recognise that the securing position has been reached properly, because the engagement operation can signal both visually and acoustically that the securing position has been reached.

The contact lock member can, at least in sections, be hinged laterally to the plugging section movably substantially transversely to the direction of plugging. Thus the contact lock member can firstly be connected undetachably to the plugging section. Secondly, hinging the contact lock member to the plugging section or the plug element can help to dictate a predetermined path of movement for transferring the contact lock member out of the pre-securing position into the securing position. Thus uncontrolled movements of the contact lock member which might lead to tilting or deformation of the contact lock member upon transferring into the securing position can be prevented.

The test member may be configured as a resiliently movable tab. Thus the test member can spring automatically back into the pre-securing position if it is not properly transferred into the securing position and/or latched in the securing position. Such a spring function can be brought about easily in particular in that the test member is formed in one piece with the plug element and is pre-tensioned in the pre-securing position. For this, the plug element and test member may for example be formed in one piece as an injection-moulded plastics part, the original state of which is the test member in the pre-securing position, out of which it has to be transferred into the securing position with a certain expenditure of force. The configuration of the test member as a tab here is not absolutely necessary, but advantageous, because the external dimensions of the plug element can thus be minimised and defined spring forces between the plugging section and test member can be brought about.

The test member may be fastened laterally to the plug element in the region of the plugging face and a free end of the test member can point substantially counter to the direction of plugging. Thus the test member can automatically be transferred from the pre-securing position into the securing position if the plug element is introduced with the plugging face first into a surrounding housing and/or into a plug receptacle of a mating plug element. The test member can extend in the pre-securing position obliquely to the direction of plugging and thus form a type of ramp, along which it is pushed or forced from the pre-securing position into the securing position if an internal contour of the surrounding housing or of the mating plug element requires the contact lock member to be transferred into the securing position for introducing the plug element.

Consequently, a test member which is blocked in the pre-securing position by at least one contact element which is not inserted properly into its receptacle can prevent the introduction of the plug element into the surrounding housing or the mating plug element and thus signal faulty insertion of the plug element. Thus the operating steps of an assembly method for a plug element according to the invention can be reduced or abbreviated, because in one operating step the plug element is inserted into the surrounding housing or mating plug element and at the same time the proper seating of the contact elements in their respective receptacles can be checked.

The invention is explained in greater detail below by way of example using several embodiments with reference to the appended drawings. The embodiments merely represent possible configurations in which individual features, as described above, can be realised and omitted independently of each other. In the description of the embodiments, for simplicity the same features and elements are provided with the same reference numerals.

Therein:

Figure 1:
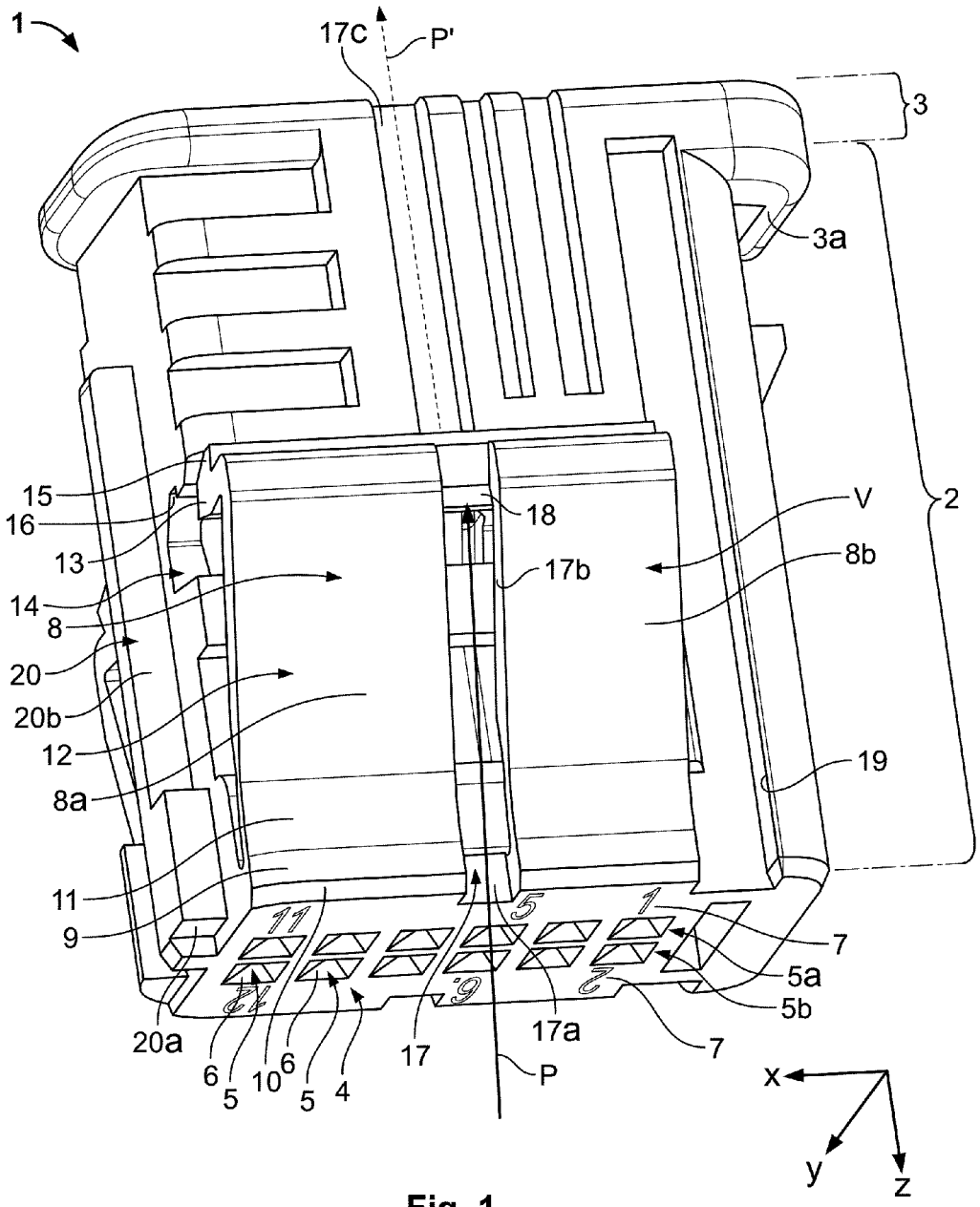
FIG. 1 depicts a diagrammatic perspective view of a plug element according to the invention.

First an embodiment of a plug element 1 according to the invention is described with reference to the diagrammatic perspective view thereof in FIG. 1. The plug element 1 comprises a plugging section 2 and a conductor receptacle section 3. The plugging section 2 is configured to be introduced into a mating plug element (not yet shown here) and/or a surrounding housing (not shown). The conductor receptacle section 3 is configured to introduce electrical conductors (not shown) into the plug element 1.

The plugging section 2 comprises a plugging face 4 which points in a direction of plugging Z of the plug element 1 along which the plug element 1 is configured to be insertable into a surrounding housing and/or mating plug element. Contact receptacles 5 of the plug element 1 are accessible via openings 6 to the contact receptacles 5 in the plugging face 4. The contact receptacles 5 or openings 6 are arranged in two rows 6*a*, 6*b* extending in a lateral direction X of the plug element 1. The rows 5*a*, 5*b* are arranged next to one another in a transverse direction Y of the plug element 1.

The contact receptacles 5 or the openings 6 thereof are provided with markings 7 which facilitate association of contact elements or mating contact elements (not yet shown here) with the respective contact receptacles 5.

A tab-shaped contact lock member 8 is fastened laterally to the plug element 1. A root 9 of the contact lock member 8 is arranged in the region of a front edge 10 of the plugging face 4. From the root 9, the contact lock member 8 extends substantially counter to the direction of plugging Z along the outer side of the plug element 1. Initially a spring section 11 which connects the root 9 to an actuating section 12 of the contact lock member 8 adjoins the root 9. A securing element 13 of the contact lock member 8 adjoins the actuating section 12. The securing element 13 is in the form of a bar extending transversely to the direction of plugging Z or parallel to the lateral direction X, which bar extends from an end of the contact lock member 8 pointing counter to the direction of plugging Z substantially along the transverse direction Y in the direction of a test opening 14 arranged in the wall of the plug element 1.

The test opening is in the form of a securing groove 14 which extends in the lateral direction X along the wall and laterally intersects the contact receptacles 5 of the row 5*a*. A latching means 15 in the form of a latch projection on the securing element 13 is configured to cooperate with a mating latching means 16 in the form of a latching recess in the securing groove 14.

A test path P extends along a groove-shaped test recess 17 which extends along the plug element 1 in several sections 17*a-c* parallel to the direction of plugging Z. A first section 17*a* of the test recess 17 serves as an introduction section and intersects the lateral edge 10 on the plugging face 5 and the root 9 of the contact lock member 8 down to a depth at which an introduction opening for a test member which is accessible counter to the direction of plugging Z (not yet shown here) is formed on the plugging face. The first section 17*a* is adjoined counter to the direction of plugging Z by a second section 17*b* of the test recess 17, which is configured as an opening which divides the actuating section 12 into a first actuating section 12*a* and a second actuating section 12*b*. In the end of the opening which points counter to the direction of plugging Z, this extends as far down as the securing element 13, which thus forms a test stop 18 extending transversely to the direction of plugging Z.

Counter to the direction of plugging Z above the test stop 18, the test recess 17 continues into a third section 17*c* which dictates a release path P', which represents a continuation of the test path P and is reached by a test member introduced along the test path P into the test recess 17 if said member has passed the test stop 18 or the securing element 13. The test stop 18 is formed on a part of the securing element 13 which connects together two sections 8*a*, 8*b*, separated by the test recess 17, of the contact lock member 8 as a type of land. At the test stop, the test path P continues in the release path P'.

The third section 17*c* of the test recess 17 penetrates in the direction of plugging Z through a collar 3*a* of the conductor receptacle section 3, which means that a test member introduced from the plugging face 4 into the test recess 17 can be moved counter to the direction of plugging Z to beyond the conductor receptacle section 3. This facilitates checking from above the conductor receptacle section 3 whether the test member has properly passed the test stop 18.

Furthermore, the plug element 1 is provided with guide elements 19, extending parallel to the direction of plugging Z, in the form of grooves formed in the wall of the plug element, which facilitate accurate introduction of the plug element 1 into a surrounding housing or a mating plug element and thus prevent electrical mating contact elements in the form of pin contacts in the mating plug element from being damaged by a plug element which is moved or tilted obliquely to the direction of plugging Z.

Further, the plug element 1 has a coding means 20 which comprises a coding element 20*a* in the form of an asymmetrical geometric structure pointing in the direction of plugging Z and a coding guide 20*b* in the form of a land.

In the state illustrated in FIG. 1, the plug element 1 or the contact lock member 8 thereof is in a pre-securing position V, in which the securing element 13 does not engage in the contact receptacles 5. As soon as the contact receptacles 5 are equipped properly with electrical contact elements, the contact lock member 8 can be transferred by application of an actuating force F in the transverse direction Y from the pre-securing position V into a securing position S (not yet shown here), in which the securing element 13 engages in the test opening 14 and the latching means 15 is latched in the mating latching means 16. In the securing position S, the sections 17*a-c* of the test recess 17 are flush in the direction of plugging Z, so that a test member can be pushed through the first section 17*a* of the test recess 17 along the second section 17*b* thereof beyond the test stop 18 into the third section 17*c* of the test recess 17, and thus can indicate proper reaching of the securing position S.

Figure 2:
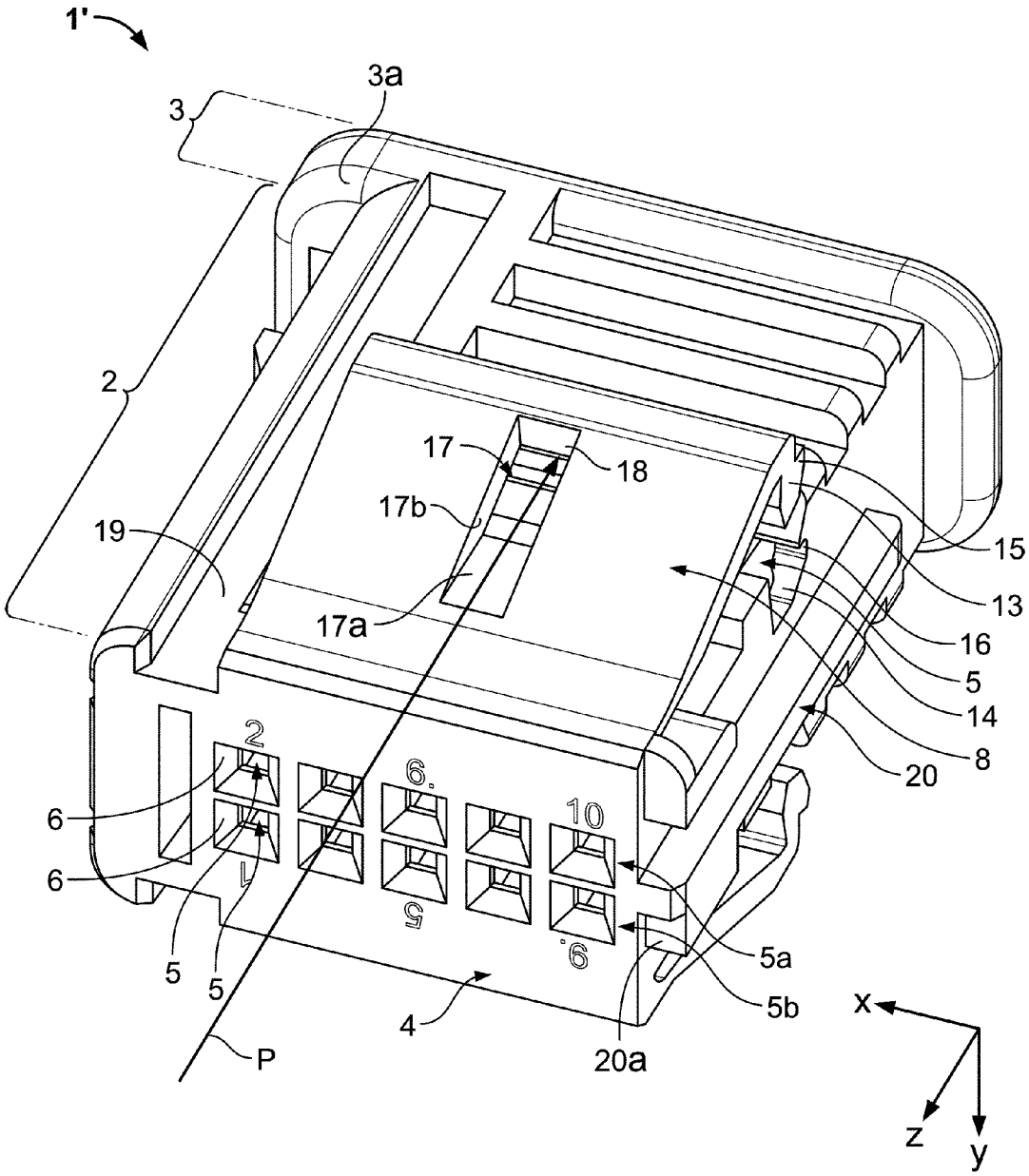
FIG. 2 depicts a diagrammatic perspective view of a further embodiment of a plug element according to the invention.

FIG. 2 depicts a further embodiment of a plug element 1' according to the invention. Unlike the plug element 1 shown in FIG. 1, the plug element 1' has a smaller number of receptacles 5 for electrical contact elements. Furthermore, the plug element 1' differs from the plug element 1 in that the test recess 17 is merely formed by a first section 17*a* and a second section 17*b*. The first section 17*a* is designed as a run-in region to the second section 17*b* of the test recess 17 which is configured as an opening in the contact lock member 8. The test path P dictated by the slot-shaped test recess 17 leads to the test stop 18. A continuation of the test path P in the form of a release path P' defined by a third section 17*c* of the test recess 17 is not provided in the embodiment of the plug element 1' illustrated in FIG. 2.

Figure 3:
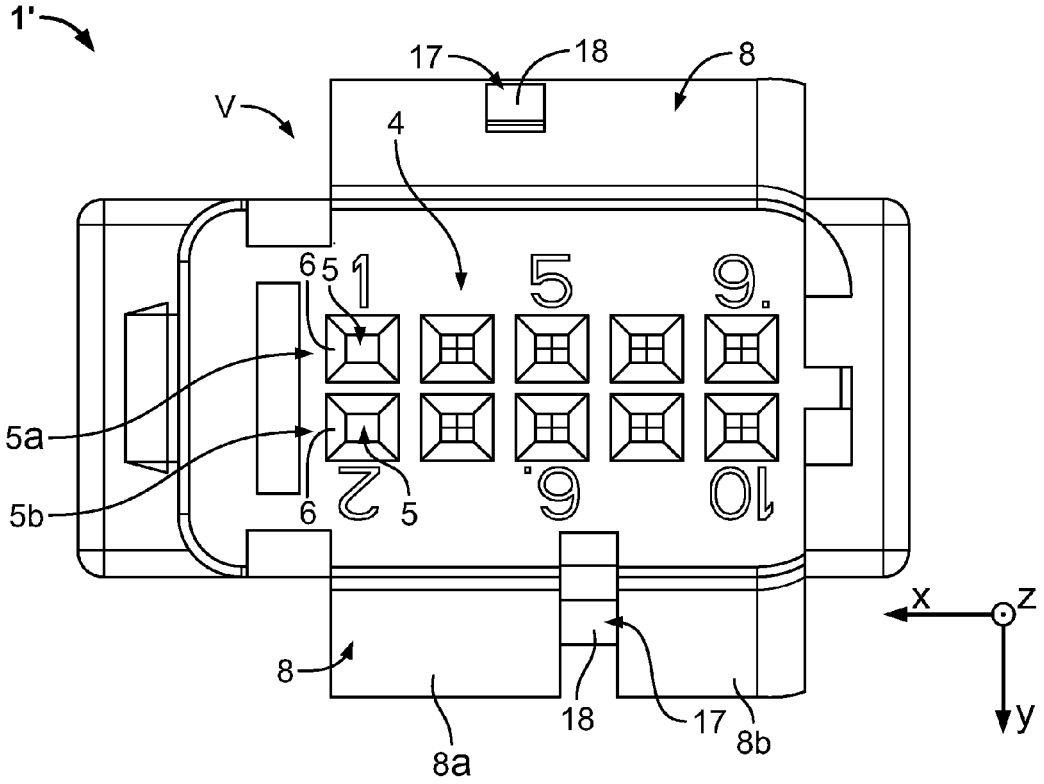
FIG. 3 depicts a diagrammatic top view of the plug element shown in FIG. 2.

FIG. 3 shows the plug element 1' illustrated in FIG. 2 in a diagrammatic top view. Here it becomes clear in particular that the test stops 18 on the contact lock members 8 point in the direction of plugging Z.

Figure 4:
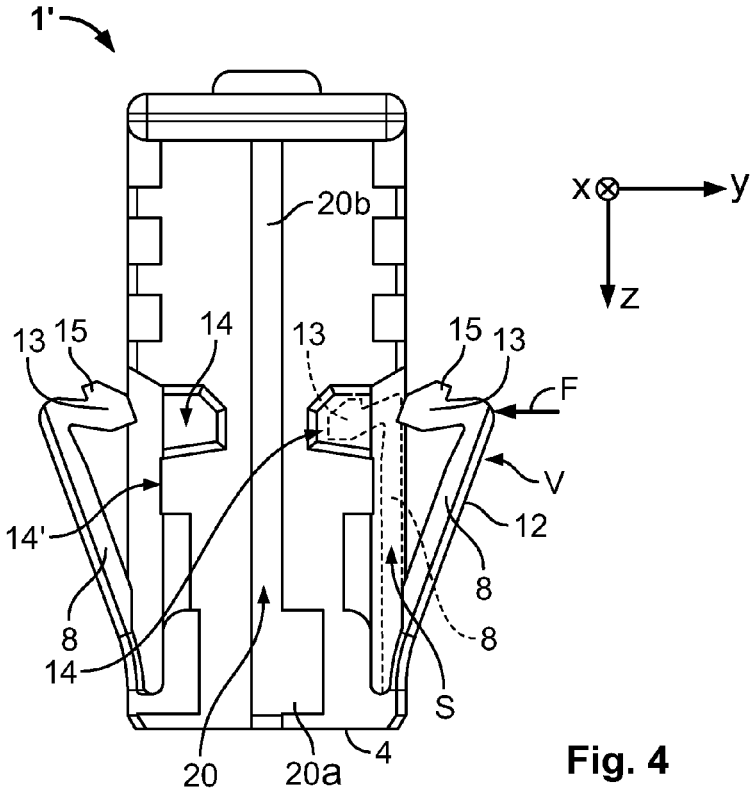
FIG. 4 depicts a diagrammatic side view of the plug element shown in FIGS. 2 and 3 from the right.

FIG. 4 is a diagrammatic side view of the plug element 1' from the right, which gives a view along the securing groove 14. The securing groove 14 is configured to be complementary to the securing element 13. As soon as the contact lock member 8 is moved towards the securing groove 14 by an actuating force F directed parallel to the transverse direction Y, the latching means 15 moves into the securing groove 14 and fills it, as long as no contact element which has been inserted incorrectly into the contact receptacles 5 overlaps with the securing groove such that transferring of the contact lock member 8 from the pre-securing position V into the securing position S is prevented.

The reaching of the securing position S is indicated in FIG. 4 by means of a securing member 8 illustrated with a broken line. As soon as the contact lock member 8 has reached the securing position S, it lies in an indentation 14' in the surface of the plugging section 2 such that it is flush with the surface, and the external dimensions of the insertion section 2 are not enlarged by the contact lock member 8.

Furthermore, it can be seen in FIG. 4 that, due to the inclined course of the actuating section 12 of the contact lock member 8 relative to the direction of plugging Z, insertion forces in the direction of plugging Z in the case of a contact lock member which is in the pre-securing position V always generate a force component in the direction of the actuating force F which causes the contact lock member to move into the securing position S as long as this is not prevented by a contact element inserted incorrectly into the plug element 1'. Thus, during the insertion of the plug element 1' into a surrounding housing or a mating plug element, at the same time the contact lock member 8 can be actuated and the correct seating of the plug elements in their respective receptacles 5 checked.

Figure 5:
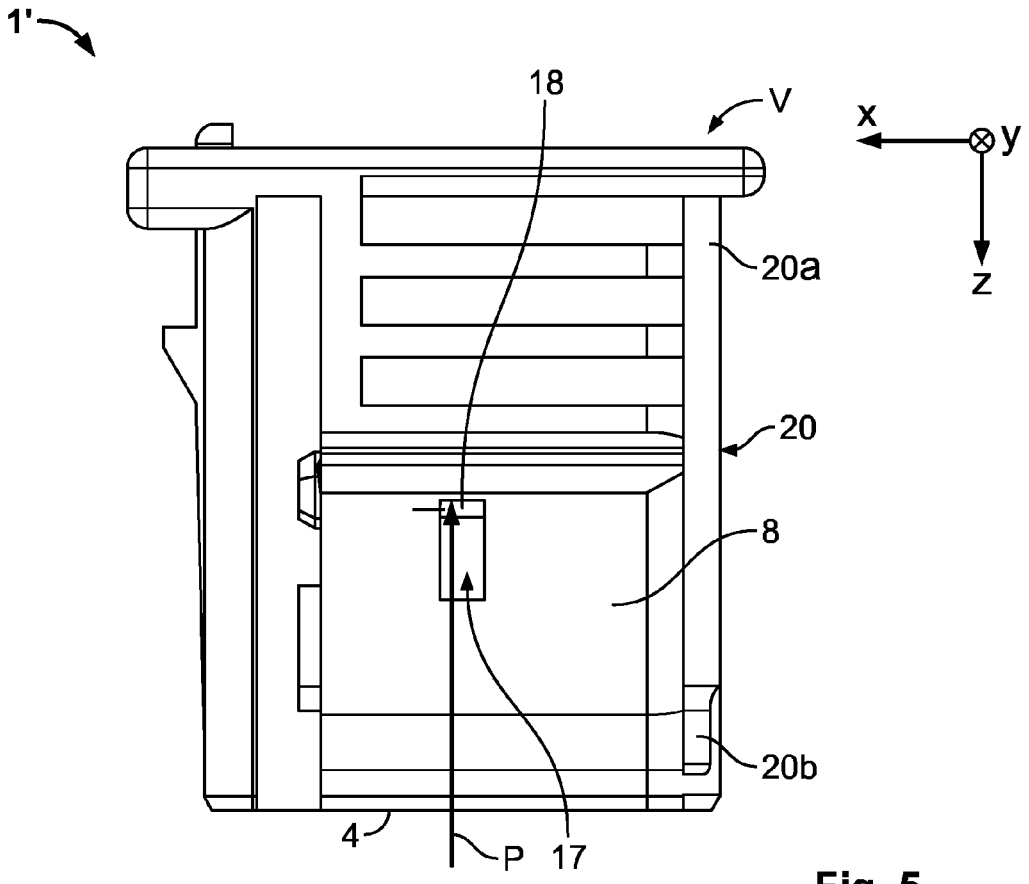
FIG. 5 depicts a diagrammatic front view of the plug element shown in FIGS. 2 to 4.

FIG. 5 is a front view of the plug element 1' shown in FIGS. 3 and 4, in which in particular it becomes clear that the test path P above the test stop 18 is not continued in defined manner. Thus a test member which after reaching the securing position S is guided counter to the direction of plugging Z along the test recess 17 can slide beyond the test stop 18.

Figure 6:
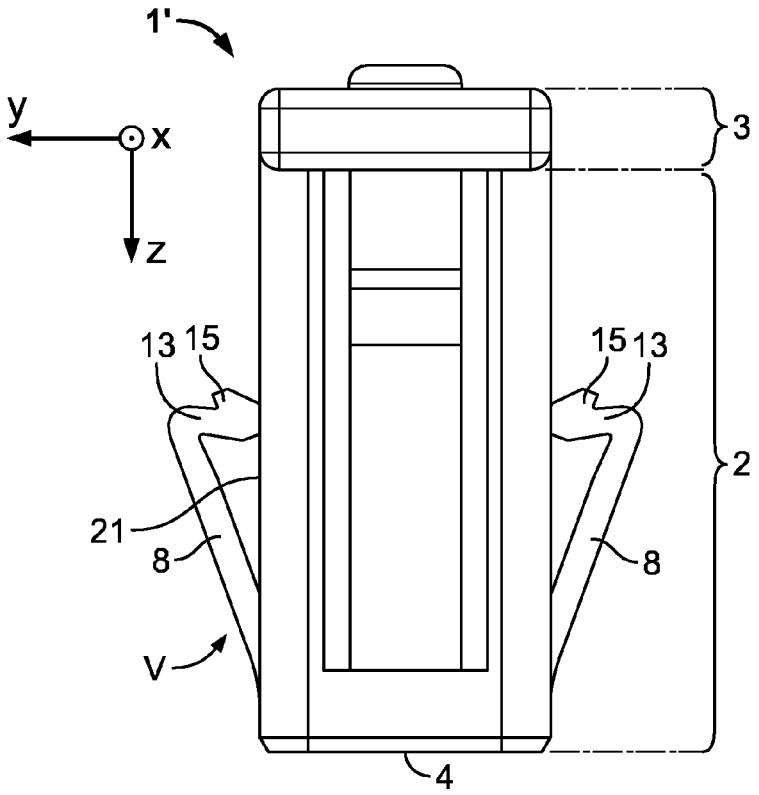
FIG. 6 depicts a diagrammatic side view of the plug element shown in FIGS. 2 to 5 from the left.

FIG. 6 is a diagrammatic side view of the plug element 1' shown in FIGS. 3 to 5 from the left. Here it once again becomes clear how the contact lock members 8 including the securing elements 13 project beyond a lateral edge 21 of the plugging section 2 in the transverse direction Y if they are in the pre-securing position V.

Figure 7:
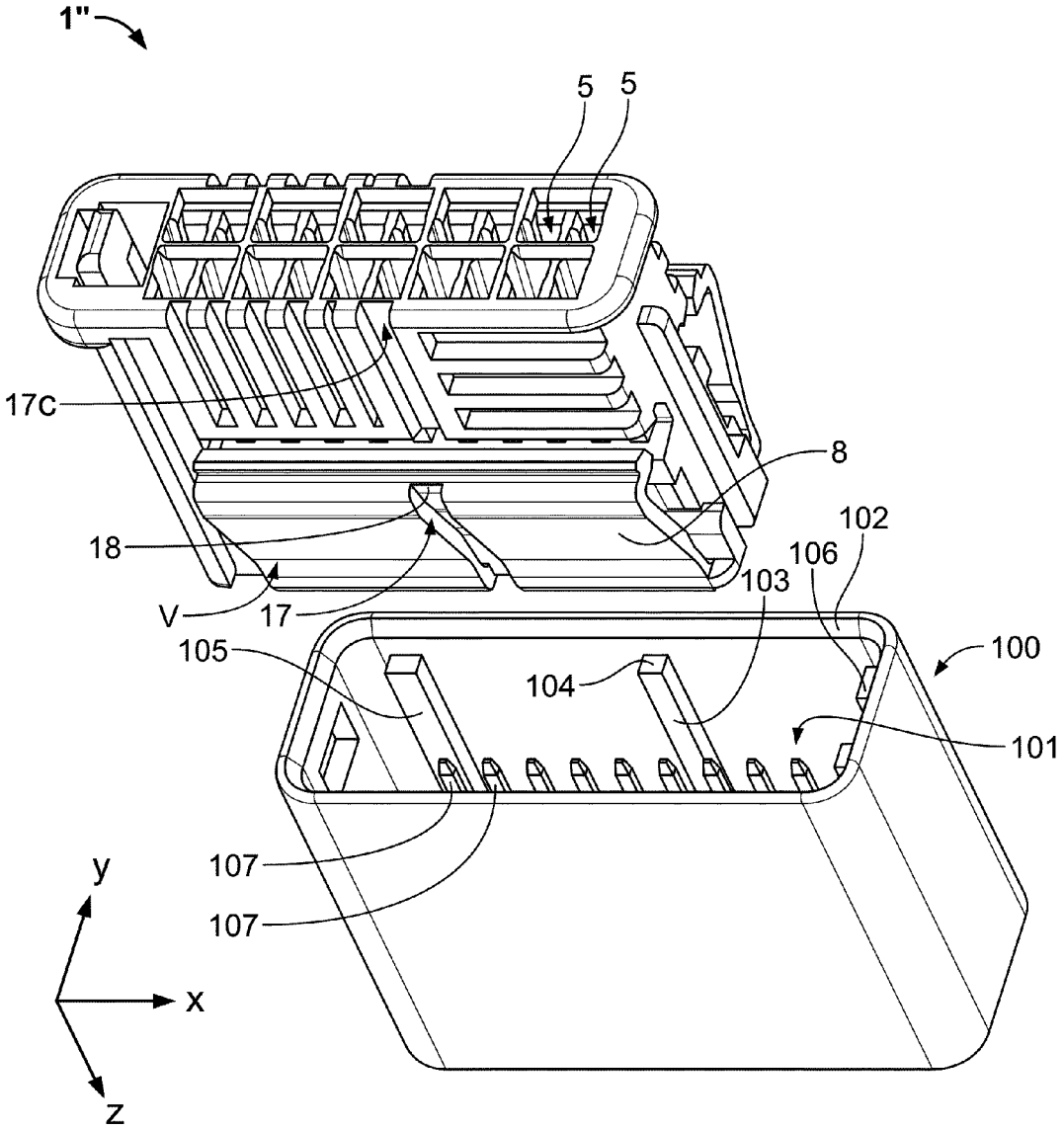
FIG. 7 depicts a diagrammatic perspective view of a further embodiment of a plug element and mating plug element according to the invention.

FIG. 7 is a diagrammatic perspective view of a further embodiment of a plug element 1" according to the invention. Furthermore, FIG. 7 contains a diagrammatic perspective view of a mating plug element 100 according to the invention. The plug element 1" and the mating plug element 100 are arranged to be fitted together in the direction of plugging Z.

Unlike the plug element 1 illustrated in FIG. 1, the plug element 1" has a higher number of contact receptacles 5. In functional terms, the construction of the contact lock member 8 including the test recess 17 and the test stop 18 is similar to the construction of the contact lock member 8 illustrated in FIG. 1.

The mating plug element 100 comprises a plug receptacle 101 with a plugging opening 102 pointing counter to the direction of plugging Z. Guide elements 103 which are configured complementarily to the test recess 17 are arranged in the plug receptacle 101. Thus the guide elements 103 may serve as test elements in the plug receptacle 101. The guide elements 103 may slide along the test recess counter to the direction of plugging Z and form a test abutment 104 pointing counter to the direction of plugging Z which buts against the test stop 18 and prevents complete insertion of the plug element 1 into the plug receptacle 101 as long as the contact lock member 8 is not transferred into the securing position S. Furthermore, polarisation elements 105 and coding elements 106 which extend parallel to the direction of plugging Z are arranged in the plug receptacle 101. The guide element 103 and the polarisation elements 105 and coding elements 106 help to introduce the plug element 1" into the plug receptacle 101 as correctly and parallel to the direction of plugging Z as possible in order to prevent mating contact elements 107 in the form of pin contacts arranged in the plug receptacle 101 from bending upon insertion.

Figure 8:
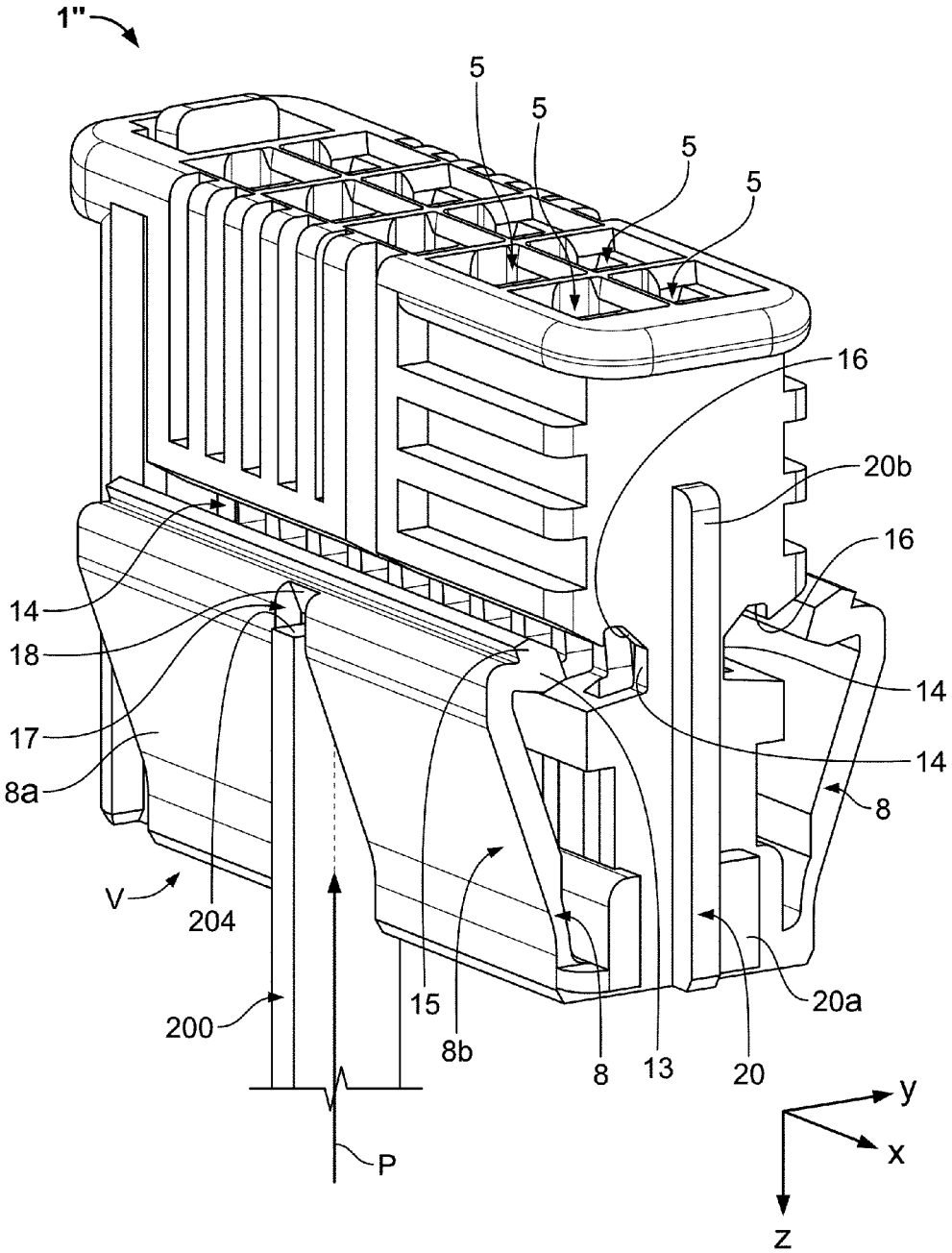
FIG. 8 depicts a diagrammatic perspective view of the plug element shown in FIG. 7 and a test member which is guided along the test path up to the test stop.

FIG. 8 shows the plug element 1" including a test member 200 introduced into the test recess 17. The test member 200 is in the form of a pin with a rectangular cross-section, which forms a test abutment 204 on its upper side pointing counter to the direction of plugging Z. The test abutment 204 buts against the test stop 18 if the test member 200 is guided along the test path P, as long as the contact lock member 8 is not transferred from the pre-securing position V illustrated in FIG. 8 into the securing position S.

Figure 9:
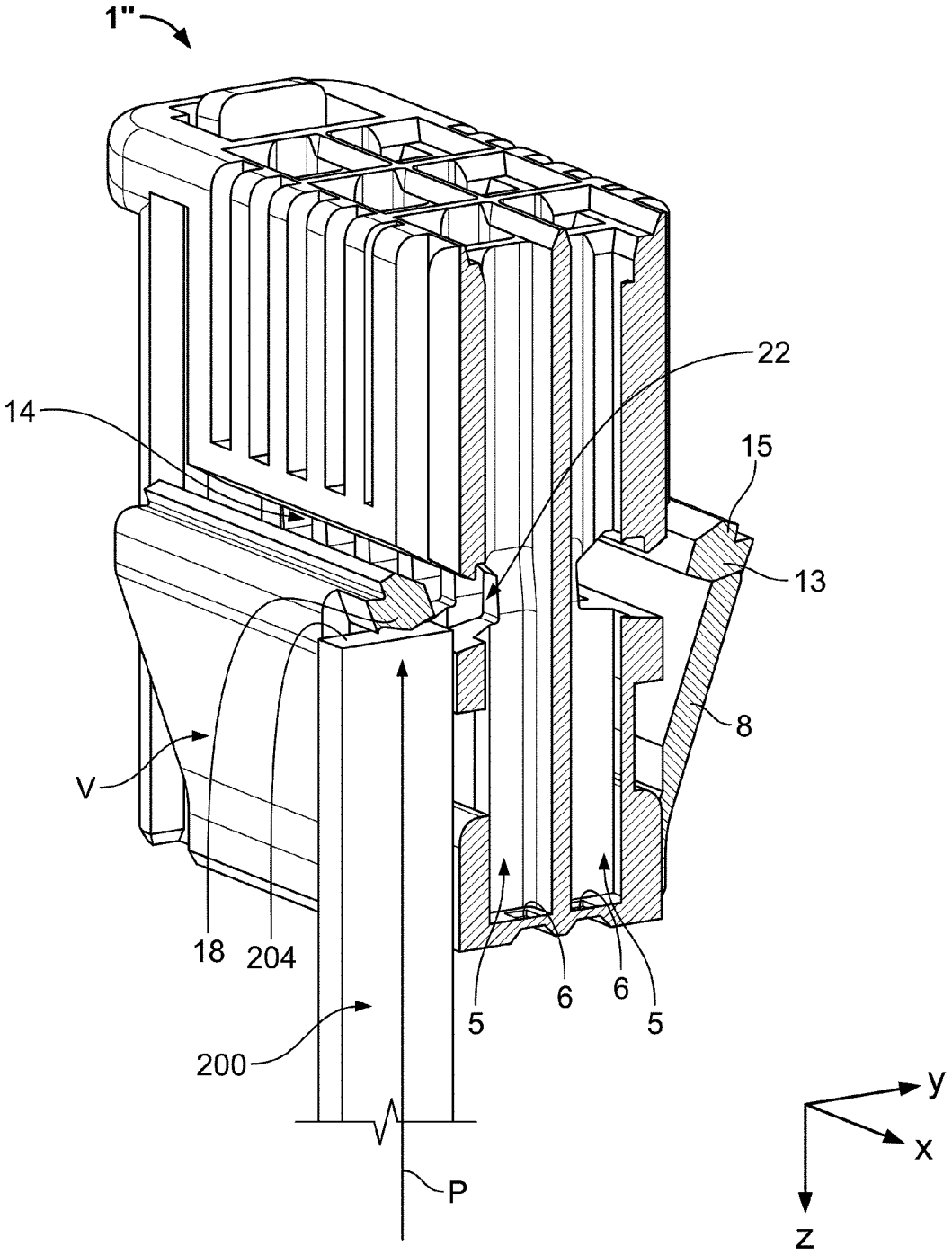
FIG. 9 depicts a diagrammatic perspective sectional view along the test recess of the plug element shown in FIG. 8.

FIG. 9 shows the plug element 1" including test member 200 illustrated in FIG. 8 in a perspective sectional view in a section plane which is spanned in the direction of plugging Z along the test path P and parallel to the transverse direction Y. Here it becomes clear that a passage 14' is positioned between the contact receptacles 5 and the securing groove or test opening 14, into which passage the contact elements project, as long as they are not correctly inserted into the contact receptacles 5. Projecting through the passage opening 22 into the securing groove 14, incorrectly inserted contact elements prevent the securing element 13 from being able to enter completely into the securing groove 14. Thus the test member 200 which is guided along the test path P buts with its test abutment 104 against the test stop 18 as long as the contact lock member is in the pre-securing position V, and thus signals faulty or incorrect equipping of the plug element 1".

Figure 10:
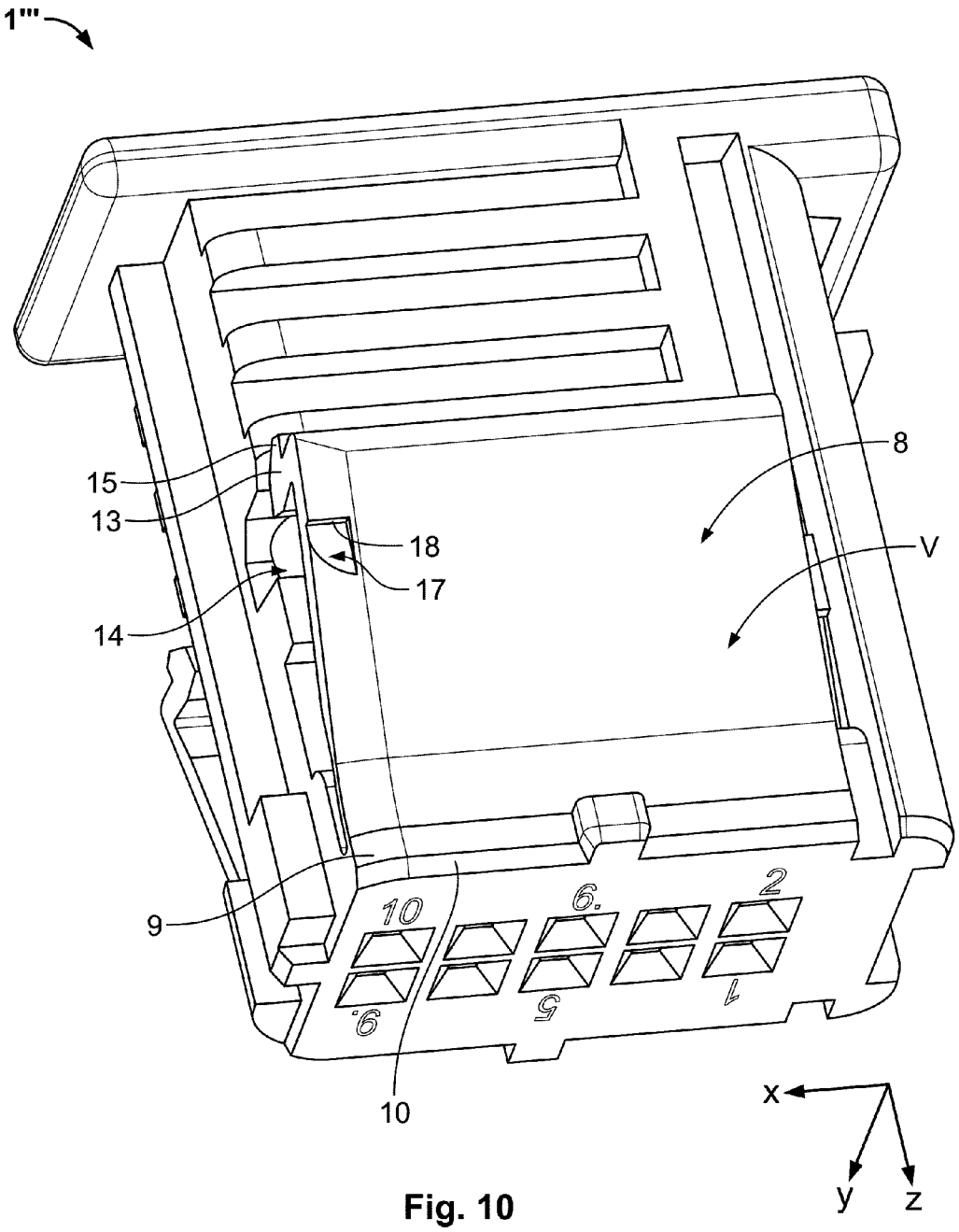
FIG. 10 depicts a diagrammatic perspective view of a further embodiment of a plug element according to the invention.

FIG. 10 shows a further embodiment of a plug element 1''' according to the invention. In the plug element 1''', the test recess 17 is formed as a simple indentation on a lateral edge of the contact lock member 8. The test stop 18 is formed on the upper end of the indentation.

Figure 11:
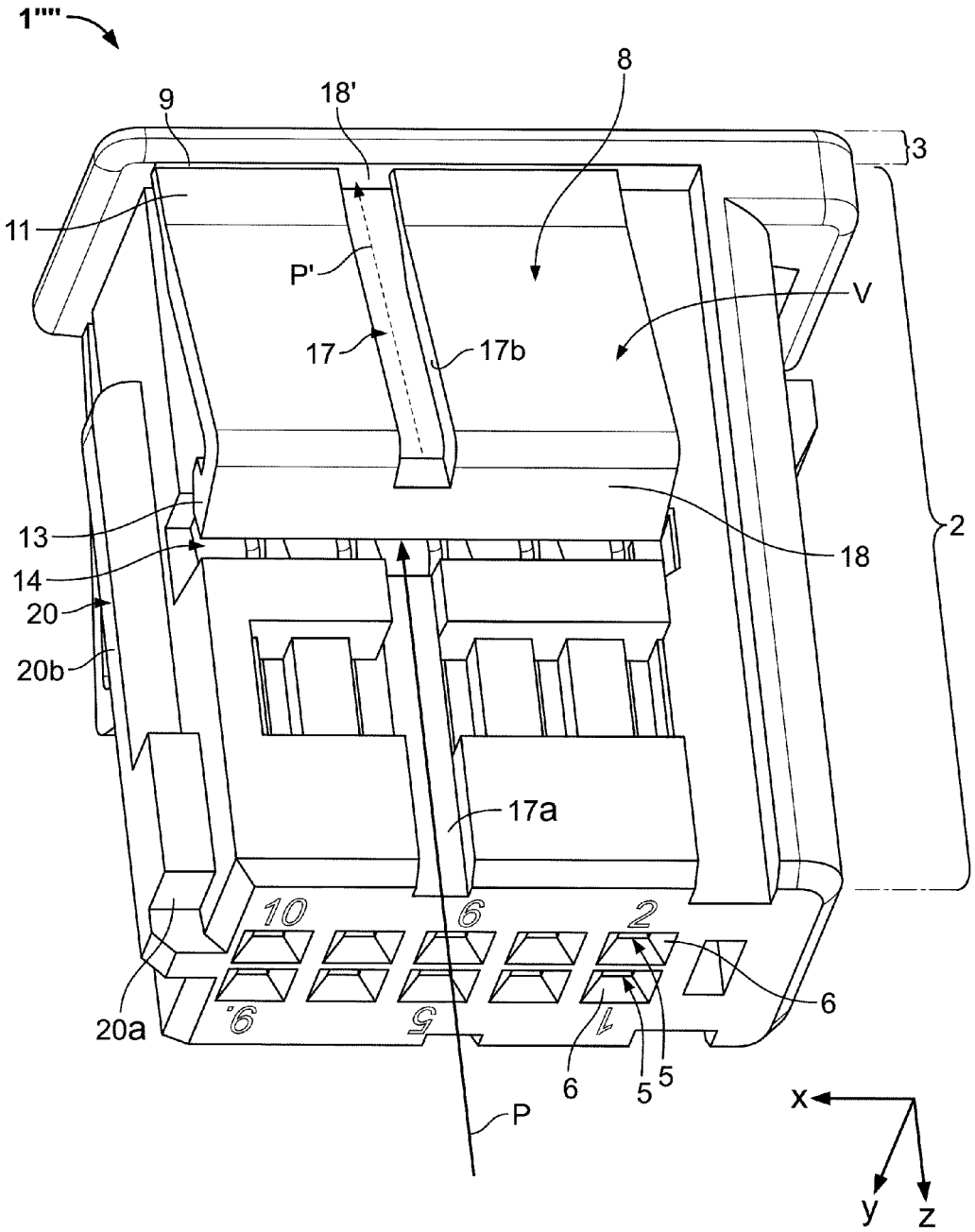
FIG. 11 depicts a diagrammatic perspective view of a further embodiment of a plug element according to the invention.

FIG. 11 shows a further embodiment of a plug element 1'''' according to the invention in a diagrammatic perspective view. Unlike the plug elements 1', 1" and 1''', in the case of the plug element 1'''' the contact lock member 8 is fastened to the upper end of the plugging section 2, so that it extends from its root 9 in the direction of plugging Z.

The surface of the securing element 13 which points in the direction of plugging Z forms the test stop 18. The test path P extends along the first section 17*a*, which is formed as a guide groove in the surface of the plug element 1'''', which groove guides a test member 200 up to the test stop 18 as long as the contact lock member 8 is in the pre-securing position V. As soon as the contact lock member 8 is in the securing position S, the first section 17*a* of the test recess 17 guides the test member 200 across the test stop 18 which is sunk in the securing groove 14 into the second section 17*b* of the test recess, which is formed by a slot extending parallel to the direction of plugging Z formed in the contact lock member 8. The second section 17*b* guides the test member 200 along the release path P' onto a release stop 18'. If the test member 200 buts against the release stop 18', a corresponding depth of penetration of the test member or the test path P and release path P' covered signals that the securing position S has been reached.

In the context of the inventive concept, deviations from the embodiments described above are possible. Thus the plug elements 1, 1', 1", 1''', 1'''' can be provided with plugging sections 2, conductor receptacle sections 3 and plugging faces 4 of any configuration whatsoever in order to form a plug-in connector corresponding to the requirements in question. The contact receptacles 5 may be formed corresponding to the plug-in contacts which are to be received in each case, which may be configured as pin contacts.

The contact lock member 8 may be of any form whatsoever, as long as its securing element can engage in the receptacles 5 such that it can secure a contact element located thereon and can signal that the securing position S has been reached. The test path P and the release path P' may be formed in any manner whatsoever in the form of openings, recesses, grooves and slots, in order to supply a test member 200 or guide element 103 reliably to a test stop 18 and a release stop 18'. Thus the contact lock member 8 may be divided into any number whatsoever of first 8*a* and second 8*b* sections in order to ensure securing of the contacts and checking of the securing position S. Furthermore, the plug element may be provided with any number of guide elements 19 and coding means 20 and collars 3*a* whatsoever which are configured in accordance with the respective requirements.

The mating plug element 100 may have a plug receptacle 101 configured complementarily to the plug element in accordance with the respective requirements, with a corresponding plugging opening 102 and also guide elements 3, a test abutment 104, polarisation elements 105 and coding elements 106. It goes without saying that any mating contact elements 107 are matched in their form and number to the contact elements received in the plug element.

Finally, the test member 200 may have a form corresponding to the respective requirements and have a test abutment 204 formed in any manner whatsoever, by the abutment of which against a test stop 18 and/or a release stop 18' the pre-securing position V or the securing position S can be signalled. The test member 200 may be formed by a guide element 103 or configured as such and have a test abutment 104, 204 corresponding to the respective requirements.

The invention claimed is:

1. A plug element for an electrical plug-in connector, with a plugging section, which is configured to be able to be brought together with a mating plug element in a direction of plugging (Z) of the plug element and has at least one receptacle for an electrical plug-in contact, and with a contact lock member, which, at least in its securing position (S), projects, at least in sections, into the receptacle, wherein the contact lock member in the securing position (S) releases a test path (P) along which a test member can be guided past a test stop wherein the test path (P), at least in sections, is formed by a test recess on the contact lock member.

2. A plug element according to claim 1, wherein the test stop is formed on the contact lock member.

3. A plug element according to claim 1, wherein the test stop, at least in a pre-securing position (V) of the contact lock member, points in the direction of plugging (Z) and the test path (P) extends parallel to the direction of plugging (Z).

4. A plug element according to claim 1, wherein the test recess is a slot.

5. A plug element according to claim 1, wherein at least one securing element which extends substantially transversely to the direction of plugging (Z) is formed on the contact lock member, which element, at least in the securing position (S), projects through a securing groove on the plugging section into the securing groove, the securing groove, at least in sections, extending transversely to the direction of plugging (Z) and extending into the at least two receptacles.

6. A plug element according to claim 5, wherein the securing element and the securing groove are configured to cooperate with each other as latching means and mating latching means.

7. A plug element according to claim 1, wherein the contact lock member, at least in sections, is hinged laterally to the plugging section movably substantially transversely to the direction of plugging (Z).

8. A plug element according to claim 1, wherein the contact lock member is configured as a resiliently movable tab.

9. A plug element according to claim 1, wherein the contact lock member is fastened in the region of a plugging face of the plug element laterally on the plug element and a free end of the contact lock member points substantially counter to the direction of plugging (Z).

* * * * *